United States Patent [19]

Baugh

[11] 4,252,090

[45] Feb. 24, 1981

[54] MECHANICAL ENGINE GOVERNOR WITH PRESSURE RESPONSIVE MINIMUM DROOP LIMITING SPEED CONTROL

[75] Inventor: Edward D. Baugh, Union Lake, Mich.

[73] Assignee: General Motors Corporation, Detroit, Mich.

[21] Appl. No.: 11,207

[22] Filed: Feb. 12, 1979

[51] Int. Cl.[3] ..... F02D 1/12

[52] U.S. Cl. ..... 123/379; 123/340

[58] Field of Search ..... 123/140 FG, 140 MC, 123/140 MD, 140 R; 74/860

[56] References Cited

U.S. PATENT DOCUMENTS

| | | | |
|---|---|---|---|
| 2,656,174 | 10/1953 | Crookston . | |
| 2,771,788 | 11/1956 | Frick et al. . | |
| 2,986,291 | 5/1961 | Schick | 123/140 R |
| 3,077,873 | 2/1963 | Parks et al. | 123/140 MD |
| 4,082,074 | 4/1978 | Baugh | 123/140 FG |

*Primary Examiner*—Harry N. Haroian

*Attorney, Agent, or Firm*—Robert J. Outland

[57] ABSTRACT

An idle speed-limiting speed engine governor utilizes a friction damped air piston as the sole speed setting means which actively opposes the speed responsive flyweights in a particular range of engine speed operation, the governor limiting speed being controllable by adjusting the air pressure acting against the piston. A minimum droop governor characteristic results with hysteresis limited by minimum friction damping of the piston. A multi-condition air pressure control system is disclosed which is capable of providing various operational modes for the air controlled limiting speed governor.

8 Claims, 3 Drawing Figures

MECHANICAL ENGINE GOVERNOR WITH PRESSURE RESPONSIVE MINIMUM DROOP LIMITING SPEED CONTROL

TECHNICAL FIELD

This invention relates to engine governors and, more particularly, to mechanical limiting speed-idle speed governors having variable limiting speed control.

BACKGROUND OF THE INVENTION

It is known in the art relating to mechanical limiting speed governors to provide a fluid actuated piston, such as an air piston, operative as a part of the governor limiting speed setting means to modify the established limiting speed upon application or variation of air pressure acting against the piston.

As an example, U.S. Pat. No. 2,771,788 Frick and HIckson shows in FIGS. 2 and 5 a speed setting arrangement in which the compression of the high speed spring 111 is varied by the movement of an air piston 105 in response to the application of air pressure against the piston under predetermined conditions, thus varying the governor limiting speed.

Another arrangement is shown in U.S. Pat. No. 2,656,174 Crookston, wherein an overspeed spring 54 and an air bias piston 66 are arranged to act in parallel fashion against the speed related force generated by the flyweights 17' of the governor. These devices, acting together with a hydraulic dashpot piston 68, are combined to provide smooth speed setting operation over a relatively wide range of speeds.

In still another arrangement, shown in applicant's U.S. Pat. No. 4,082,074 which is assigned to the assignee of the present invention, an air biased piston 92 is arranged to act in a direction supplementing the force of the speed responsive flyweights to thus provide a reduction in the governor limiting speed setting in proportion to the pressure of air applied against the piston 92.

These prior art arrangements utilize the application of fluid pressure to a piston in various ways to modify the limiting speed setting of a mechanical engine governor. However, they all combine the fluid piston speed modifying means with a conventional spring to provide at least a portion of the speed setting force that acts against the speed responsive flyweights, or similar mechanism. The biasing force thus created establishes the limiting speed setting which is matched by the speed related force of the flyweights at the point of governor balance. The use of such biasing springs in mechanical engine governors in which the speed balanced condition may occur at various positions of spring compression inherently introduces a certain amount of speed droop, or limiting speed variation with load, into the system. In addition, some degree of friction is provided which creates hysteresis but has the advantage of damping oscillations of the mechanism, thus helping to provide a stable speed control system.

While a certain amount of speed droop and hysteresis is acceptable for most engine speed governing functions, these characteristics are not so desirable when it is desired to use the governor for some other related purposes. For example, the speed droop characteristic inherent in the governor arrangement of the previously mentioned U.S. Pat. No. 4,082,074 causes a variation in the controlled speed under varying load conditions, which is undesirable when the engine governor is used as a vehicle speed control, one of the uses of the governor described in the patent. This speed variation is, however, quite acceptable when the governor is performing its primary function of engine speed control or while it is used to control the engine speed for an auxiliary drive system.

SUMMARY OF THE INVENTION

The present invention provides an improved mechanical engine governor with fixed or variable limiting speed settings which is particularly adapted not only for use in controlling engine speed and auxiliary engine powered devices, but also to provide relatively constant vehicle speed control when incorporated in a suitable speed control system.

It is a feature of the invention that it essentially eliminates or minimizes the speed droop characteristic in a mechanical engine governor over the active range of controlled engine limiting speeds. This is accomplished by completely eliminating the use of a biasing spring as an operative element in controlling governor limiting speeds in the normal range of controlled limiting speeds. Instead, a fluid, and preferably air, actuated piston is utilized as the sole operative element utilized to provide a speed setting force that opposes the speed responsive force of the flyweights in establishing a fixed or variable limiting speed within the range of available limiting speeds for the governor.

A further feature of the invention is the provision of appropriate control systems and devices which in conjunction with the air controlled governor provide the capability of an engine speed control system usable for various additional purposes such as vehicle speed control or variable speed control of engine powered accessory devices.

These and other features and advantages of the invention will be more fully understood from the following description of a preferred embodiment taken together with the accompanying drawing.

BEST MODE FOR CARRYING OUT THE INVENTION

Figure 1:
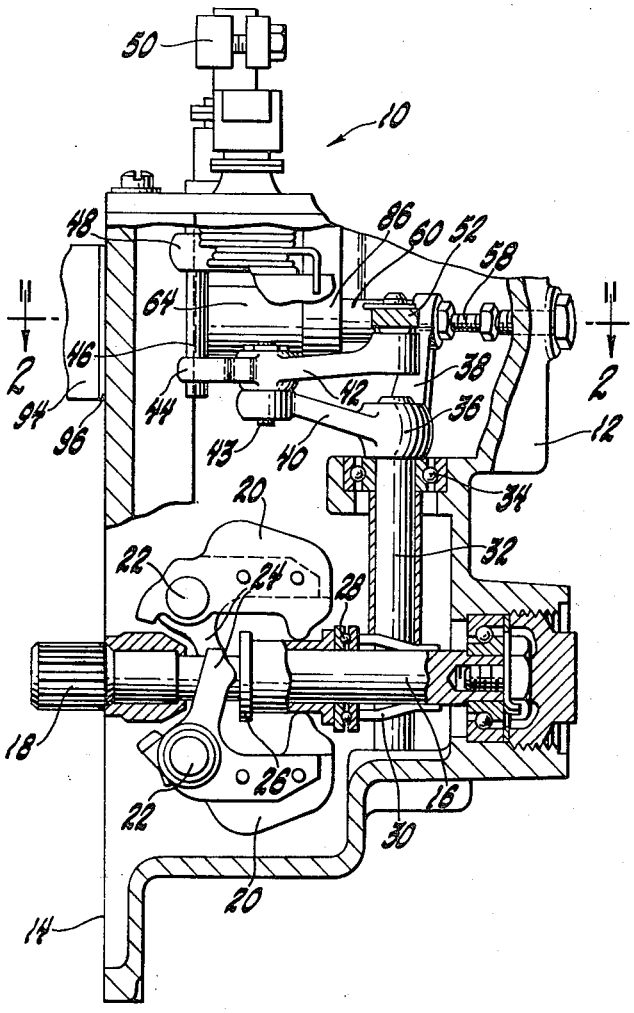
FIG. 1 is a fragmentary cross sectional view showing certain internal portions of an air controlled minimum droop mechanical engine governor formed according to the invention.

Referring now to the drawings in detail, the best mode now known to me for carrying out the invention is exemplified in the engine governor generally indicated by numeral 10. Governor 10 comprises a mechanical engine governor especially adapted for controlling the position of fuel racks for a compression ignition engine and includes a housing 12 having a mounting surface 14 which is adapted to be secured to the end face of a blower housing or some other suitable portion of a compression ignition engine.

Within the housing 12 is a rotatable shaft 16 having a splined end portion 18 that is adapted to be connected to the rotating blower shaft, or other suitable portion of the engine, for driving the shaft 16 at a speed proportional to engine speed. Shaft 16 carries a pair of pivotally mounted flyweights 20 which, upon increasing speed, are increasingly urged outwardly by centrifugal force around pivots 22. Fingers 24 extending from the flyweights engage a sleeve 26 which acts through a bearing 28 on an operating fork 30. The fork 30 is connected to an operating shaft 32 that is mounted for oscillation in bearings, only one 34 of which is shown. The operating shaft 32 is fixed to an operating shaft lever 36 having a pair of angularly disposed arms 38, 40.

At the end of arm 40 of the operating shaft lever, a differential lever 42 is pivotally mounted intermediate its ends on a pivot pin 43. One end 44 of lever 42 is bifurcated to receive the end of a pin 46 extending from operating mechanism 48 which is adapted to be connected through an external lever 50 with the accelerator, not shown, of a vehicle or other means for manual control of the engine by the operator. At its other end, differential lever 42 is pinned to a link 52, which is in turn connected to an oscillating lever 54 having an end portion 56 connectable with the engine fuel rack actuating means, not shown, for moving the engine injector racks between their maximum and minimum fuel positions.

The other arm 38 of operating shaft lever 36 carries an adjusting screw 58 which engages a cup shaped cap 60 carried for reciprocation within a recess 62 of a cylindrical plunger 64. A low (idle) speed spring 66 extends between the cap 60 and a seat 68, operatively connected to the plunger 64 by an adjusting screw 69 for setting the spring preload.

The portions of the governor mechanism so far described are substantially the same as corresponding portions of certain previously known governors, including the governor described in my aforementioned U.S. Pat. No. 4,082,074. Differing portions of the mechanism of the herein disclosed governor are described subsequently.

Cap 60 has an open end 70 that is engagable with a washer-like spring seat 72, biased by a relatively strong overspeed spring 74 toward engagement with an annular seat 76 formed by an enlargement in the plunger recess 62. The overspeed spring is in turn seated on a screw plug 78 that is threadably received within an open end 80 of the plunger 64. It will be noted that plug 78 also threadably retains the idle speed spring adjusting screw 69.

Plunger 64 is reciprocably disposed within a cylindrical bore 82 formed in the housing and in an axially spaced relatively smaller cylindrical bore 84 formed in a support member 86 that forms a further portion of the housing. At its extreme rightward position, an annular flange 88, formed by a diametral step on the plunger, engages the side of the support member 86, thereby stopping rightward movement of the plunger at a point where its open end 80 is flush with or preferably extends slightly proud of the associated outer wall 92 of the housing 12.

Surrounding the protruding end 80 of the plunger, there is secured to the wall 92 of the housing a cylinder 94 having an open end sealingly engaging the wall 92 through a gasket 96 that surrounds the end 80 of the plunger. Cylinder 94 also has a closed end including a threaded opening 98 adapted for connection to a supply of pressurized air.

Within the cylinder 94 there is reciprocably disposed a piston 100 having an annular groove 102 in which is disposed a sealing ring 104. The end 106 of the piston adjacent the sealing ring is closed to define with the closed end of the cylinder an air chamber 108 to which the threaded opening 98 is connected.

Opposite its closed end 106, the piston has a hollow skirt portion 110, the end of which is adapted to engage the open end 80 of the plunger 64. Within the hollow skirt is disposed a minimum speed spring 112 having a biasing force substantially less than that of the overspeed spring 74 and on the order of that of the idle spring 66. Spring 112 operatively acts against the inner side of the piston closed end 106 and the plunger 64 through engagement with the screw plug 78, thus providing a predetermined biasing force acting on the plunger and urging the piston 100 and plunger 64 apart.

Figure 2:
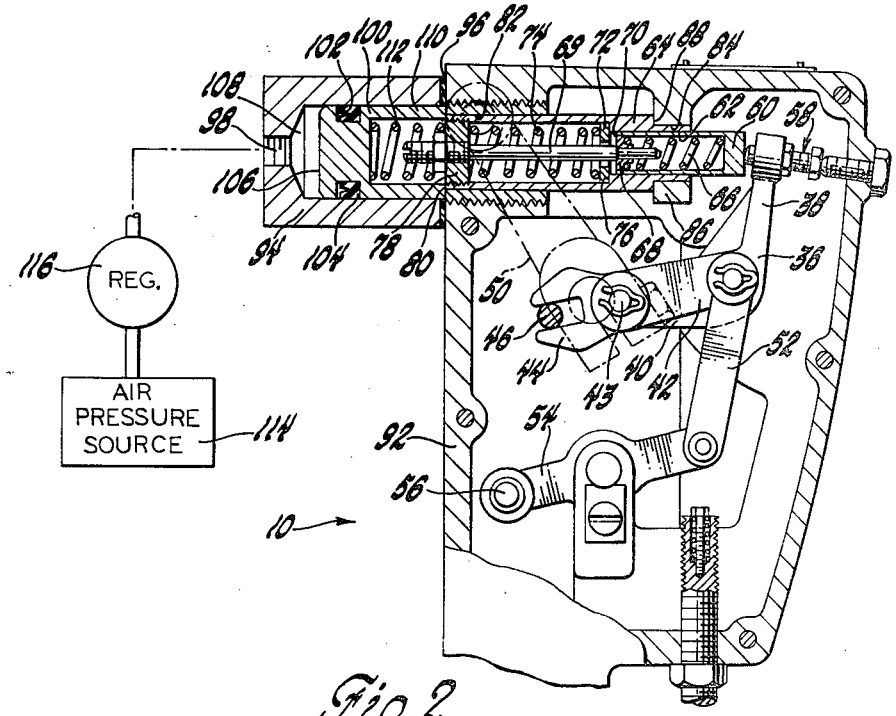
FIG. 2 is a partial cross sectional view taken generally in the plane indicated by the line 2—2 of FIG. 1 and showing internal portions of the governor speed setting system together with part of its external air pressure supply.

To provide for normal operating of the governor as so far described, it is necessary to provide a suitable source of air at controlled pressure to the air chamber 108. This is accomplished by connecting to the threaded opening 98 any suitable source of pressurized air such as an air pump or pressurized air storage tank as represented in FIG. 2 by numeral 114. Between the air pressure source 114 and the chamber 108, there is connected a pressure regulator 116 which may be preset to a predetermined control pressure or provided with means to vary the pressure as desired. Regulator 116, which may be of any type available commercially or otherwise, is operative to maintain the preset pressure within the air chamber 108 of the cylinder under substantially all conditions of engine operation.

GOVERNOR OPERATION

The operation of the governor arrangement of FIGS. 1 and 2 as above described is as follows.

When its associated engine is in operation, the shaft 16 of the governor will be rotated at a speed proportional to engine speed, causing the flyweights 20 to move outwardly and apply a force that increases with increasing engine speed and tends to rotate the operating shaft lever 36 in counterclockwise direction as viewed in FIG. 2. Such movement of the speed responsive means (which includes lever 36) moves the pivot pin 43 laterally, causing the differential lever 42 to swing in a clockwise direction, as shown in FIG. 2, around the pin 46. This movement in turn moves the internal actuating means comprising link 52 and lever 54 in a direction tending to move the external fuel rack actuating mechanism, not shown, of the engine toward the minimum fuel position.

The force generated by the flyweights is opposed initially by the bias of low speed spring 66, the force of the control air pressure supplied to chamber 108 being normally sufficient to hold the plunger 64 in its farthest rightward position with its flange 88 against the side of the support member 86. At idle speeds, the low speed spring 66 extends cap 60 against the adjusting screw 58 in the lever 36 and controls the engine idle speed by yielding or extending as necessary to permit the flyweight force to control fuel flow at the required amount for maintaining idle speed.

Actuation of the foot throttle or accelerator of the vehicle by the operator to increase engine speed moves the lever 50 so that pin 46 is moved generally downwardly as shown in FIG. 2, pivoting lever 42 and the internal actuating means toward a fuel increasing position of increased injector rack (assuming a diesel engine is involved). The resultant speed increase causes an increase in force from the flyweights which completely compresses spring 66, causing the open end 70 of the cap 60 to engage the high speed spring set 72. This seat is firmly held in engagement with the annular seat 76 of the plunger by the relatively high biasing force of the overspeed spring 74. Thus, engagement of the cap end 70 with the spring seat 72 stops further leftward movement of the cap 60 until accompanied by either movement of the plunger 64 or yielding of the overspeed spring 74.

Between idle and the air pressure controlled maximum limiting speed, the fuel rack position is set manually by the engine operator. However, when the maximum controlled limiting speed is reached, the force of the flyweights 20 becomes high enough to balance and subsequently overcome the biasing force caused by the controlled air pressure supplied to the cylinder chamber 108. As this occurs, the plunger 64 and the engaged piston 100 are moved leftwardly, as shown in FIG. 2, as necessary to reduce the engine injector output by moving the injector racks toward their minimum fuel position so that the established governor limiting speed is not exceeded by the engine.

The established governor limiting speed may be fixed if the air pressure regulator 116 controlling the pressure of air in chamber 108 is preset to a fixed pressure. If desired, however, the governor limiting speed may be made adjustable by providing means for adjusting the pressure supplied by the pressure regulator 116 to the air chamber 108.

Because control of the preset limiting speed established by the governor is controlled by an air pressure source external to the governor, two additional provisions are made in the governor structure for operation of the engine on occasions when air pressure is temporarily unavailable or is improperly controlled. For example, in the case of a vehicle mounted engine where an engine driven pump pressurizing a storage tank is utilized as the source of pressurized air, it is necessary to provide some means of operating the engine at idle speed under conditions when no pressurized air is available in the system for controlling the governor. In such a situation, the minimum speed spring 112 extending between the piston 100 and plunger 64 urges the plunger rightwardly as shown in FIG. 2 with a biasing force sufficient to hold the plunger in its rightward position against the slightly lower force of the idle speed spring 66. Thus, the minimum speed spring 112 provides sufficient biasing force to operate the engine at idle speed and thereby permits building up air pressure in the air system to a point where sufficient pressure is available to charge the chamber 108 to a pressure suitable for operation of the engine at normal governor controlled speeds. On the other hand, should improper control of the air pressure system lead to a situation where the air pressure in chamber 108 is raised above the normal speed controlling pressure to exert a force greater than the bias of the overspeed spring 74, then increase of the engine speed to an overspeed condition will cause the overspeed spring 74 to yield, allowing the force of the flyweights acting through the cap 60 and spring seat 72 to compress the overspeed spring without moving the plunger 64. In this case, the engine fuel racks will be moved to a reduced fuel position without the necessity of moving the plunger or the air biased piston 100, thereby maintaining the engine speed at or below its predetermined overspeed level.

OPTIONAL AIR CONTROL SYSTEM

Figure 3:
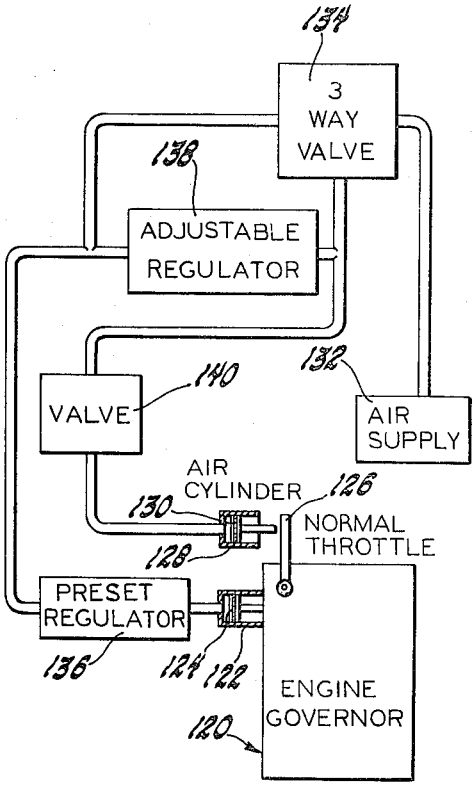
FIG. 3 is a schematic view of a governor air supply and control system as applied to a governor of the type shown in FIGS. 1 and 2 to provide a variable use engine governor speed control system.

FIG. 3 of the drawings illustrates an optional air control system for use in a vehicle provided with an air controlled minimum droop governor in accordance with the present invention. In the figure, numeral 120 generally indicates the governor of a vehicle mounted engine wherein the governor includes the features described with respect to the governor of FIGS. 1 and 2. Governor 120 includes a control air cylinder 122 having a piston 124 which is capable of being biased by air pressure supplied to the cylinder to provide preestablished governor and engine limiting speeds in the manner previously described.

The governor is also provided with a throttle lever 126 which corresponds to the lever 50 in the embodiment of FIGS. 1 and 2. A second air cylinder 128 and associated piston 130 are provided which, when charged with pressurized air, engage the throttle lever 126 to move it into its full fuel rack position for a purpose to be subsequently described.

The system includes a suitable pressure air supply 132 which is controlled by a three-way valve 134. This valve directs air either directly to a preset regulator 136, which establishes the maximum air pressure supplied to cylinder 122, or indirectly to the preset regulator 136 through an adjustable regulator 138 which is capable of reducing the pressure of air supplied to the preset regulator. When the three-way valve is adjusted to supply air to the adjustable regulator, it also supplies air pressure to a shut off valve 140. When opened, valve 140 permits passage of the air to air cylinder 130, thus causing the piston 128 to move the manual throttle to its full fuel position.

OPERATION OF THE OPTIONAL CONTROL SYSTEM

The optional air pressure control system of FIG. 3 may be operated to control the engine in any one of three possible modes. In a first mode, movement of the three-way valve 134 to a first position, wherein air is passed directly to the preset regulator 136, brings about what might be considered normal operation of the engine governor, with a preset fixed maximum engine limiting speed provided by the governor in the normal manner. Speeds below the preset limiting speed are controlled conventionally by the operator's movement of his foot throttle to control, at will, the position of the throttle lever 126.

A second mode of operation is provided by moving the three-way valve 134 to a second position in which air is supplied through the adjustable regulator 138 to the preset regulator 136, and the valve 140 is maintained closed. In this operating mode, the engine throttle is also operated normally, but the governor limiting speed is adjustable by adjustment of the regulator 138 to any selected air pressure. This pressure may be controlled by the operator, if desired, or it may be selected by connection with some engine connected device such as the transmission of the vehicle so that, for example, a higher engine limiting speed may be provided in lower gears, while a predetermined lower limiting speed would be provided in the high gear of the transmission, thereby limiting maximum vehicle speed in a desired manner.

A third mode of operation corresponds to what might be desirable for use of the governor as a vehicle speed control. In this mode, the three-way valve 134 is again moved to the second position so that air is supplied through the adjustable regulator 138 to the preset regulator 136. In addition, valve 140 is opened to supply full pressure air to the air cylinder 128, thereby actuating the piston 130 to move the throttle lever 126 to its full fuel position. With this arrangement, engine speed control is separated from movement of the manual throttle by the operator and is instead taken over by the governor, as determined by the air pressure provided thereto through adjustment of the adjustable regulator 138. Control of this regulator by the operator provides operation of the engine at a controlled engine speed of the operator's selection for as long as the system is maintained in the particular operating mode. Cutoff of the control system and return to the first or normal mode of operation could be accomplished by any desired system such as, for example, the control system described in my previously mentioned U.S. Pat. No. 4,082,074.

It may be seen from the foregoing that the present invention provides a novel air pressure control governor system and optional associated air control system which permit considerable flexibility of application and use in conjunction with vehicle mounted engines as well as for other engine applications. It should be noted that, in operation of a governor in accordance with the present invention, control of the engine at the governor provided limiting speed is accomplished without the movement of any of the springs provided within the governor. Thus, it is apparent that, during normal speed limiting operation at the governor limiting speed setting, the sole operative speed setting biasing element is the air piston provided as a part of the governor speed setting means. The operation of the various springs provided within the governor occur solely under various extremes of governor operation such as during an overspeed condition, at engine idle or at operation where no air pressure is present to provide the normal governor control.

As a result of the feature of speed limiting control by an air piston as the sole operative element in the biasing system, the present invention provides a governor system which is essentially free of speed droop of the type normally caused by mechanical movement of governor mechanisms to various positions in response to varying loads. This is because when the air pressure on the piston is controlled to a fixed amount, the pressure does not vary because of movement of the piston. Thus the force of the piston acting against the speed responsive flyweight mechanism does not vary with position. This differs from the usual governor arrangements in which compression of the usual speeder spring, or high speed spring, causes a change in the biasing load of the spring at various positions which results in the speed droop characteristic.

While it might be considered that operation of an engine governor without significant speed droop would result in an unstable governing condition, initial testing of this concept has indicated that minimum hysteresis in the system, caused by the friction forces of the piston within the cylinder and the other mechanism within the governor, is sufficient to adequately damp the system and provide for stable operation. However, should some need for additional damping be present under certain conditions of engine operation, it would be possible within the scope of the present invention to introduce into the system additional means for damping oscillations such as additional friction devices, fluid dashpots or other well known devices suitable for accomplishing the desired purpose.

While the invention has been disclosed by reference to a preferred embodiment and system, it should be understood that numerous changes could be made in specific design and structural features without departing from the inventive concepts disclosed. Accordingly, it is intended that the invention not be limited to the features of the described embodiment, but that it have the full scope permitted by the language of the following claims.

The embodiments of the invention in which an exclusive property or privilege is claimed are defined as follows:

1. The combination of a speed limiting governor of the type wherein fuel control means are actuatable above an established limiting speed that is set by the biasing force of speed setting means which are opposed by speed responsive means exerting a force increasing as a function of increasing speed and operative to move the fuel control means in a fuel reducing direction when the established limiting speed is exceeded, and the improvement wherein said speed setting means comprise a pressure responsive movable member acting in opposition to said speed responsive means and constituting the sole active speed setting element operative in a particular range of limiting speeds, and means supplying a controlled fluid pressure against said pressure responsive member to establish said speed setting means biasing force which determines the limiting speed.

2. The combination of a speed limiting governor of the type wherein a fuel control linkage is actuatable above an established limiting speed that is set by the biasing force of speed setting means which are opposed by speed responsive means exerting a force increasing as a function of increasing speed and operative to move the fuel control linkage in a fuel reducing direction when the established limiting speed is exceeded, and the improvement wherein said speed setting means comprise a friction damped piston reciprocable in a cylinder and defining therewith a pressure chamber varying in volume upon movement of the piston, said piston operatively engaging said speed responsive means with a biasing force established by the reaction of the piston to the pressure of fluid in said pressure chamber, said piston constituting the sole active speed setting element operative in a particular range of limiting speeds, means supplying a controlled fluid pressure to said pressure chamber to act against said piston to develop said speed setting means biasing force which determines the governor limiting speed and provide limiting speed control with a minimum droop characteristic.

3. The combination of claim 2 and further comprising a caged overspeed spring operatively disposed intermediate said piston and said speed responsive means, said spring having a biasing force in the installed condition that is substantially greater than said speed setting means biasing force which determines the established limiting speed, said spring yielding to provide control of the fuel rack linkage movement only upon a substantial overspeed condition being reached.

4. The combination of claim 2 and further including a starting and idle speed spring operatively disposed between said piston and said speed responsive means, said starting spring having a biasing force substantially lower than the normal speed setting means biasing force, said starting spring being operative to provide a minimum biasing force adequate to permit operation at near idle speed under conditions where no fluid pressure is supplied to the pressure chamber.

5. An air actuated engine speed control comprising an engine speed limiting governor having air pressure responsive means solely operative to establish a governed engine limiting speed as a direct function of air pressure supplied to said pressure responsive means and further having a fuel control lever movable between maximum and minimum fuel positions to control engine fuel supply at speeds below the governed limiting speed, a source of air pressure connected with said pressure responsive means, and an air pressure regulator connected intermediate said pressure source and said pressure responsive means, said regulator being preset to supply a fixed maximum fluid pressure to said pressure responsive means to establish a predetermined engine limiting speed for said governor.

6. The speed control of claim 5 and further comprising a three-way valve having an inlet and first and second outlets and connected between said regulator and said pressure source, said pressure source being connected with said inlet and said first outlet being connected directly with said regulator, a controllable air pressure regulator connected between said second valve outlet and said first named regulator and controllable to vary the pressure of air supplied from said valve second outlet to said first regulator, said three-way valve being movable to either of first or second positions in which said inlet is respectively connected to either said first or said second outlet, whereby in said first valve position said engine limiting speed is maintained at that established by said first preset air pressure regulator and in said second valve position said engine limiting speed is variable under control of said second controllable air pressure regulator.

7. The speed control of claim 6 and further comprising an air cylinder operatively engagable with said governor fuel control lever and operative upon connection with an air supply to move said lever into its maximum fuel position, said cylinder being connected with said three-way valve second outlet to provide for actuation of said air cylinder concurrent with variable limiting speed control by said controllable regulator.

8. The speed control of claim 7 and further comprising a valve intermediate said air cylinder and said three-way valve to provide or cut off air supply to said air cylinder and thus provide variable limiting control with or without concurrent actuation of the air cylinder.

* * * * *